US007004805B2

(12) United States Patent
Lee et al.

(10) Patent No.: US 7,004,805 B2
(45) Date of Patent: Feb. 28, 2006

(54) DIRECTABLE EXHAUST FOR WATER SPORT TOW BOAT

(75) Inventors: Richard D. Lee, Incline Village, NV (US); Timothy M. Lopes, Merced, CA (US)

(73) Assignee: Fineline Industries, Inc., Merced, CA (US)

( * ) Notice: Subject to any disclaimer, the term of this patent is extended or adjusted under 35 U.S.C. 154(b) by 0 days.

(21) Appl. No.: 10/608,787

(22) Filed: Jun. 26, 2003

(65) Prior Publication Data

US 2004/0083726 A1 May 6, 2004

Related U.S. Application Data

(60) Provisional application No. 60/422,351, filed on Oct. 30, 2002.

(51) Int. Cl.
*B63H 21/34* (2006.01)

(52) U.S. Cl. ..... 440/89 R; 60/324

(58) Field of Classification Search ..... 440/89 R, 440/89 G; 114/211; 60/324
See application file for complete search history.

(56) References Cited

U.S. PATENT DOCUMENTS

| | | | | |
|---|---|---|---|---|
| 4,586,908 A | * | 5/1986 | Schlichthorst | 440/89 R |
| 4,601,666 A | | 7/1986 | Wood, Jr. | |
| 4,786,265 A | * | 11/1988 | Porter | 440/89 R |
| 4,863,404 A | * | 9/1989 | Salo | 440/38 |
| 5,299,961 A | | 4/1994 | Okamoto | |
| 6,135,834 A | * | 10/2000 | Polakowski | 440/89 R |
| 6,299,496 B1 | * | 10/2001 | Griffiths et al. | 440/89 R |

FOREIGN PATENT DOCUMENTS

| | | |
|---|---|---|
| DE | 19 22 978 | 11/1970 |
| DE | 36 29 520 | 3/1988 |
| DE | 44 03 405 | 8/1995 |
| GB | 344 735 | 3/1931 |

OTHER PUBLICATIONS

United States Coast Guard, "Carbon Monoxide—The Silent Killer," Rogers Marine Surveyors, Feb. 3, 2003, pp. 1-3, Washington, D.C.
Jim Flannery, "Turn Off Your Gas-Powered Generator When Moored or Docked to Avoid CO Risk" and "CG Extends Warning to All Gas Generators" [from Soundings, May 2001, p. 7], pp. 1-6.
Maureen West, "Fun in the Sun Turns Tragic for Kids-7 Families Tell Moving Stories," Aug. 27, 2001, The Arizona Republic (Reprinted from azcentral.com), pp. 1-4.
MMWR Weekly, Sep. 20, 2002, pp. 1-3.
Safety Advisory, 2001-02: "Teak Surfing" & Carbon Monoxide, Intermountain Region-Risk Management Office, Jun. 29, 2001, p. 1.
International Search Report Dated Mar. 22, 2004.

* cited by examiner

*Primary Examiner*—Andrew D. Wright
(74) *Attorney, Agent, or Firm*—Fulwider Patton LLP

(57) ABSTRACT

The directable exhaust for a wake surfing power boat permits directing exhaust out of either the port or starboard side of a boat opposite the wake wave on which a wake surfer is surfing to avoid exposure of the person to the exhaust fumes. Valves which direct the exhaust out of the side of the boat are linked such that the exhaust can be directed out of either the port or starboard side of the boat away from the wake surfer by a single control available to the boat operator.

8 Claims, 1 Drawing Sheet

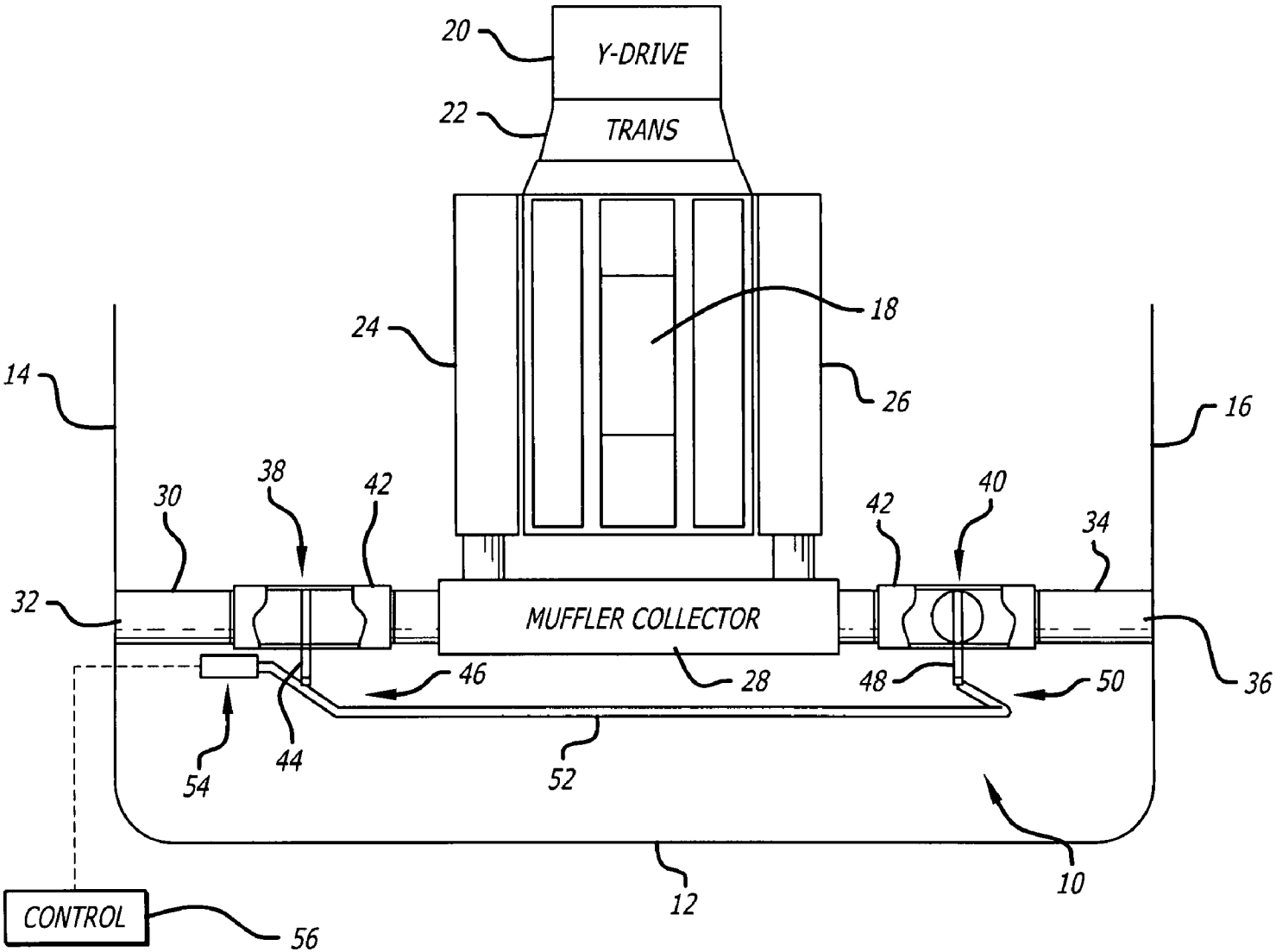
Y-DRIVE
TRANS
MUFFLER COLLECTOR
CONTROL
10
12
14
16
18
20
22
24
26
28
30
32
34
36
38
40
42
42
44
46
48
50
52
54
56

DIRECTABLE EXHAUST FOR WATER SPORT TOW BOAT

RELATED APPLICATIONS

This patent application is based on Provisional Application No. 60/422,351, filed Oct. 30, 2002.

BACKGROUND OF THE INVENTION

1. Field of the Invention

This invention relates generally to an apparatus and method for exhausting fumes of a power motor boat, and more particularly concerns an apparatus and method for directing exhaust fumes of a power motor boat away from a person wake surfing behind the power motor boat to reduce exposure of the person to the exhaust fumes.

2. Description of Related Art

Wake surfing behind power boats has become a popular sport, and in response, manufacturers of such power boats used for wake surfing have created new configurations of boats which enhance the size of the waves produced behind and to the port and starboard sides of the power boats to improve the sport and the opportunities for more spectacular surfing on lakes and rivers. As the sport has become more popular, certain limitations on existing boats used for the purpose have been identified. One such limitation is that most boats used for the purpose have exhaust systems which direct the exhaust out of the back of the boat either above or below the water line, thus causing the wake surfer behind the boat and to either the port or starboard side to be exposed to exhaust fumes and carbon monoxide contained in the exhaust, thus diminishing the enjoyment and safety of the sport.

Ambient carbon monoxide concentrations as high as 27,000 parts per million (ppm) have been measured at the stern of power boats involved in boating fatalities attributed to carbon monoxide. The World Health Organization has recommended that the maximum exposure to carbon monoxide that a person should receive during a 15 minute interval is 87 ppm. The U.S. National Park Service and U.S. Coast Guard have recently documented 17 fatalities and 37 non-fatal carbon monoxide poisonings resulting from exposure to engine exhaust from ski boats and cabin cruisers, most of which occurred while on or near a swim platform or seated in the stern of the boat. However, carbon monoxide blood concentrations of drowning victims are rarely measured, so that it is possible that the number of drownings and non-fatal incidents due to carbon monoxide poisonings from power boat exhaust may be much higher. The U.S. Coast Guard consequently issued a safety alert in 2001 advising boaters not to "engage in the dangerous and illegal practice of teak surfing," in which a person holds on to a swim platform while a wake forms, and then trails behind the boat while holding on to the swim step.

Although power boat exhaust valves are known that can be used to direct engine exhaust through the transom or stern of a boat, these are typically designed to prevent exhaust fumes from entering the deck area of a power boat, or for purposes of sound reduction, and none of these systems reduce the carbon monoxide exhausted behind the boat and to either the port or starboard side of a power boat where a person would wake surf. It would therefore be desirable to provide an apparatus for substantially reducing the presence of exhaust fumes behind and/or to one side of a power boat, and for substantially reducing the danger to a person behind and to one side of the power boat, such as a wake surfer trailing behind such a power boat, from exposure to exhaust fumes, and particularly carbon monoxide, from such a power boat. The present invention meets these and other needs.

SUMMARY OF THE INVENTION

Briefly and in general terms, the present invention provides for an apparatus and method for directing exhaust out of either the port or starboard side of a boat away from a person behind and to either the port or starboard side of the power motor boat to avoid exposure of the person to the exhaust fumes. In a presently preferred alternative embodiment, the exhaust may be directed vertically to exhaust the fumes up and away from a wake surfer in a wave directly behind the boat. In the case where the person behind the power boat is wake surfing, the apparatus permits the engine exhaust to be directed to either side of the boat away from the wake wave on which the wake surfer is surfing, thus diminishing the amount of exhaust fumes to which the surfer is exposed.

According to the invention, valves which direct the exhaust out of the side of the boat are linked such that the exhaust can be directed out of either the port or starboard side of the boat away from the wake surfer by a single control available to a boat operator or observer on the boat. In one presently preferred configuration, dual valves in the exhaust system are connected to an engine exhaust manifold such that directing the exhaust to the starboard side of the boat closes off the flow of exhaust to the port side of the boat, and directing the exhaust to the port side of the boat closes off the flow of exhaust to the starboard side of the boat. In one aspect, the flow of exhaust from one side of the boat to the other is switched by a control unit. In another preferred aspect, starboard and port exhaust pipes may be connected to the engine exhaust manifold at about a 90 degree angle. The coordinated operation of the dual valves may be linked by an electrical control mechanism such that the valves will direct exhaust to one side or the other on the basis of a single electrical switch located conveniently to the operator or an observer in the boat. In another embodiment, linkage of the valves may be mechanical in nature, and the valve mechanisms may be linked to a single mechanical control such as a control cable located in the cockpit or convenient to an observer in the boat.

In an alternative embodiment, the system of the invention can also be used to divert exhaust in a vertical direction, a distance sufficient to reduce the exhaust which trails behind the boat at the water level. In such an embodiment, the diversion valves may either direct the exhaust to one side or the other as described above, or divert the exhaust to a vertical exhaust pipe extruding a desired distance above the boat.

By use of the invention, wake surfing is substantially enhanced and any danger associated with exposing the wake surfer to exhaust fumes is substantially diminished.

Other features and advantages of the present invention will become more apparent from the following detailed description of the preferred embodiments in conjunction with the accompanying drawing, which illustrates, by way of example, the operation of the invention.

BRIEF DESCRIPTION OF THE DRAWING

The FIGURE is a schematic diagram of a preferred embodiment of an apparatus for directing a boat's engine exhaust out of either the port or starboard side of the boat, according to the invention.

DETAILED DESCRIPTION OF THE PREFERRED EMBODIMENTS

While power boat exhaust valves commonly direct engine exhaust through the transom or back end of a boat, this typically does not reduce carbon monoxide levels from boat engine exhaust behind and/or to one side of the boat.

As is illustrated in the drawings, the invention is embodied in a directable exhaust system 10 for directing a engine exhaust of a boat (not shown) out of either the port or starboard side of the boat, away from a person behind the boat, such as a wake surfer, for example, to reduce exposure of the person to the engine exhaust and potentially dangerous carbon monoxide fumes. The boat typically has a transom at the aft end or stern 12, a port side 14, and a starboard side 16. The boat is typically a power motor boat having an engine 18, a V-drive 20, a transmission 22, and at least one exhaust manifold, such as port and starboard exhaust manifolds 24, 26. The exhaust manifolds may include a muffler collector 28 connected to the exhaust manifolds to receive the exhaust from the exhaust manifolds, and a first exhaust conduit 30, having a port side exhaust outlet 32, is connected to the muffler collector of the exhaust manifolds. A second exhaust conduit 34, having a port side exhaust outlet 36, is similarly connected to the muffler collector. In one aspect, the first and second exhaust conduits are typically connected by the muffler collector to the engine exhaust manifolds at about a 90 degree angle.

Valve means are provided for directing the engine exhaust out of one of the port and starboard exhaust outlets, such as a port butterfly valve 38 connected to the first exhaust conduit for controlling flow of engine exhaust through the first exhaust conduit to the port exhaust outlet, and a starboard butterfly valve 40 connected to the second exhaust conduit for controlling flow of engine exhaust through the second exhaust conduit to the starboard exhaust outlet, each valve having a valve housing 42. The port butterfly valve includes a port valve shaft 44, having a port valve shaft arm 46, and the starboard butterfly valve includes a starboard valve shaft 48 having a starboard valve shaft arm 50. Means for linking the first and second valves are provided, such as a connector rod 52 which can be connected to each of the valve shaft arms, such that opening of the starboard butterfly valve closes the port butterfly valve, as is illustrated, and opening the port butterfly valve closes the starboard butterfly valve. In this manner the engine exhaust is directed out of one of the port and starboard side exhaust outlets but not the other. The action of the connector rod linkage in controlling the coordinated operation of the valves can be controlled by an actuator motor, such as an electric actuator motor 54, which may be connected to a controller unit 56 with an electrical switch (not shown) that can be located in the boat in a place convenient for the boat operator or an observer, such as on the deck of the boat. Either alternatively or in addition to the electrical control of the coordinated operation of the valves by control of the actuator motor, a mechanical control of the connector rod connected between the first and second valves may be provided, as for example a control cable, such as a control cable available under the trade name "MORSE CABLE" from Morse Controls Ltd. of the United Kingdom, for opening one of the valves and closing the other of the valves. The mechanical control can be located in the cockpit of the boat convenient to an operator of the boat, for example, or otherwise may be located elsewhere convenient to an observer in the boat. Alternatively, the valves may be electrically actuated individually, operating under a coordinated control system such that opening one valve closes the other.

While the invention has been described in terms of an apparatus for directing exhaust gases to one side or the other for an inboard power boat, the system described may be used with slight modification to provide the same benefits for inboard/outdrive systems in which the engine and outdrive are a unit with the engine in the boat connected to an outdrive propulsion unit of either the propeller or jet drive type. It will also be appreciated by those skilled in the art that the apparatus of the invention can be used to direct exhaust in directions other than to one side or the other, such as vertically, to reduce the exhaust fumes in the wake of the boat.

EXAMPLE

Power Boat Exhaust System Carbon Monoxide Test

Standard Exhaust

Carbon monoxide levels were measured behind a Centurion Avalanche test boat with standard transom exhaust ports, with a Thermo Gas Tech Screamer™ personal portable carbon monoxide monitor at about 2 PM at the Fineline Merced factory Test Lake, with light cross winds from approximately the southeast at about 0 to 5 mph. Air samples were taken approximately 5 inches behind the boat and 4 inches off the water. With the boat path northwest with the wind, the peak carbon monoxide level was found to be 250 ppm. With the boat path southeast into the wind, the peak carbon monoxide level was found to be 130 ppm. Both of these measured levels were well above the World Health Organization's recommended maximum carbon monoxide level of 87 ppm.

Side Draft Exhaust

Carbon monoxide levels were measured behind a Centurion prototype Cyclone test boat with side draft exhaust ports out the starboard side, with the same portable carbon monoxide monitor at about 10 AM at the Fineline Merced factory Test Lake, with light cross winds from approximately the southeast again at about 0 to 5 mph. Air samples were taken approximately 5 inches behind the boat on the left side or port side of the wake and 4 inches off the water. With the boat path northwest with the wind, the peak carbon monoxide level was found to be 14 ppm. With the boat path southeast into the wind, the peak carbon monoxide level was found to be 0 ppm. Both of these measured levels were well below the World Health Organization's recommended maximum carbon monoxide level of 87 ppm. These results demonstrate a significant reduction in the carbon monoxide levels, and demonstrate that the switching of exhaust to one of the port and starboard sides of a boat according to the invention can have a significant effect in reducing carbon monoxide levels from boat engine exhaust behind and on the other side of boat.

It will be apparent from the foregoing that while particular forms of the invention have been illustrated and described, various modifications can be made without departing from the spirit and scope of the invention. Accordingly, it is not intended that the invention be limited, except as by the appended claims

What is claimed is:

1. An apparatus for directing a boat's engine exhaust away from a person behind the boat to reduce exposure of the person to the engine exhaust, the boat having a engine with at least one exhaust manifold, the apparatus comprising:

a port side exhaust outlet connected by a first exhaust conduit to the at least one engine exhaust manifold of the boat;

a starboard side exhaust outlet connected by a second exhaust conduit to the at least one engine exhaust manifold of the boat; and valve means connected to said first and second exhaust conduits for directing the engine exhaust out of one of the port and starboard exhaust outlets, the valve means including a first valve connected to the first exhaust conduit for controlling flow of engine exhaust through the first exhaust conduit to the port side exhaust outlet, and a second valve connected to the second exhaust conduit for controlling flow of engine exhaust through the second exhaust conduit to the starboard side exhaust outlet, and a connector rod forming a mechanical linkage between said first and second valves for reciprocal motion so that opening of one of the first and second valves simultaneously closes the other of the first and second valves, such that the engine exhaust is directed out of one of the port or starboard side exhaust outlets.

2. The apparatus of claim 1, wherein said first and second exhaust conduits are connected to the at least one engine exhaust manifold at about a 90 degree angle.

3. The apparatus of claim 1, further comprising a controller unit operatively connected to said connector rod for opening one of said first and second valves and closing the other of said first and second valves.

4. The apparatus of claim 3, wherein controller unit comprises a mechanical control connected to said mechanical linkage for opening one of said first and second valves and closing the other of said first and second valves.

5. A method for directing a boat's engine exhaust out of either the port or starboard side of the boat, away from a person behind the boat to reduce exposure of the person to the engine exhaust, the boat having an engine with at least one exhaust manifold, a port side exhaust outlet connected by a first exhaust conduit to the at least one engine exhaust manifold of the boat, and a starboard side exhaust outlet connected by a second exhaust conduit to the at least one engine exhaust manifold of the boat, a flow of engine exhaust to said port and starboard exhaust outlets being controlled by first and second valves in said first and second exhaust conduits, respectively, the method comprising:

controlling a flow of engine exhaust to permit the flow of engine exhaust through one of the port and starboard side exhaust outlets by simultaneously opening one of the first and second valves and closing the other of the first and second valves, such that directing the engine exhaust out of one of the port and starboard side exhaust outlets prevents directing the engine exhaust out of the other of the port and starboard side exhaust outlets.

6. An apparatus for directing a power boat's engine exhaust away from a wake wave on which a person is wake surfing behind and to one of the port and starboard sides of the power boat to reduce exposure of the person to the engine exhaust, the power boat having an engine with at least one exhaust manifold, the apparatus comprising:

a port side exhaust outlet connected by a first exhaust conduit to the at least one engine exhaust manifold of the power boat;

a starboard side exhaust outlet connected by a second exhaust conduit to the at least one engine exhaust manifold of the power boat;

a first electrical controlled valve connected to the first exhaust conduit for controlling flow of engine exhaust through the first exhaust conduit to the port side exhaust outlet;

a second electrically controlled valve connected to the second exhaust conduit for controlling flow of engine exhaust through the second exhaust conduit to the starboard side exhaust outlet; and a controller unit operatively connected to said first and second electrically controlled valves for reciprocally switching one of the first and second electrically controlled valves open and the other of the first and second electrically controlled valves closed, such that the engine exhaust is directed out of one of the port or starboard side exhaust outlets.

7. The apparatus of claim 6, wherein said first and second exhaust conduits are connected to the at least one engine exhaust manifold at about a 90 degree angle.

8. A method for directing a power boat's engine exhaust out of either the port or starboard side of the power boat, away from a wake wave on which a person is wake surfing behind the power boat and to one of the port and starboard sides of the power boat to reduce exposure of the person to the engine exhaust, the power boat having an engine with at least one exhaust manifold, the boat having a an engine with at least one exhaust manifold, a port side exhaust outlet connected by a first exhaust conduit to the at least one engine exhaust manifold of the boat, and a starboard side exhaust outlet connected by a second exhaust conduit to the at least one engine exhaust manifold of the boat, said port and starboard exhaust outlets being connected to said at least one exhaust manifold by first and second electrically controlled valves, respectively, the method comprising:

controlling flow of engine exhaust by simultaneously opening one of the first and second electrically controlled valves and closing the other of the first and second electrically controlled valves to permit the flow of engine exhaust through one of the port and starboard side exhaust outlets, such that directing the engine exhaust out of one of the port and starboard side exhaust outlets prevents directing the engine exhaust out of the other of the port and starboard side exhaust outlets.

* * * * *